US010617240B2

(12) United States Patent
Mittal et al.

(10) Patent No.: US 10,617,240 B2
(45) Date of Patent: Apr. 14, 2020

(54) DUVET INSERTS AND METHODS OF MANUFACTURE THEREOF

(71) Applicant: Sysco Guest Supply, LLC, Somerset, NJ (US)

(72) Inventors: Khushboo Mittal, Somerset, NJ (US); Mohan Kandhasamy, Somerset, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 433 days.

(21) Appl. No.: 14/717,687

(22) Filed: May 20, 2015

(65) Prior Publication Data

US 2016/0338513 A1 Nov. 24, 2016

(51) Int. Cl.
*A47G 9/02* (2006.01)

(52) U.S. Cl.
CPC ..... *A47G 9/0207* (2013.01)

(58) Field of Classification Search
CPC .. A47G 9/0207; A47G 9/0284; A47G 9/0261; A47G 9/02; A47G 2009/0269
USPC ..... D6/603
See application file for complete search history.

(56) References Cited

U.S. PATENT DOCUMENTS 2,135,779 A * 11/1938 Zayotti ..... A47G 9/0207 2/274
D156,238 S * 11/1949 Hoffman ..... D6/603
2,544,797 A * 3/1951 Lippmann ..... A47G 9/0207 156/62.2
3,541,620 A * 11/1970 Chapuis ..... A47G 9/0207 2/272
D250,494 S 12/1978 Householder
D319,366 S 8/1991 Popovich et al.
5,358,768 A * 10/1994 Wiley, III ..... B60N 3/044 15/215
D378,483 S * 3/1997 Kiefer ..... D6/608
D389,361 S 1/1998 Nilsson
5,720,058 A * 2/1998 Hollander ..... A47G 9/0207 5/486
D392,497 S * 3/1998 Mansfield ..... D6/603
D392,833 S 3/1998 Haban
D395,974 S 7/1998 Mansfield
D397,578 S 9/1998 Mansfield
6,009,579 A * 1/2000 Pedersen ..... A47C 21/022 5/482
D434,590 S 12/2000 Faulkender et al.
(Continued)

*Primary Examiner* — Eric J Kurilla
(74) *Attorney, Agent, or Firm* — Bracewell LLP; Brad Y. Chin; Vivek P. Shankam

(57) ABSTRACT

Duvet inserts are provided with at least two chamfered or beveled corners to prevent overhanging of the corners. Additional drag caused by the overhanging corners and frequent handling of duvet inserts by the corners causes migration of fillers contained therein and this is mitigated by the chamfered corners. Again, sectional barriers, preferably by stitching zigzag, waves or triangle wave stitches along the periphery of duvet inserts are capable of minimizing migration of fillers. Furthermore, quilted or line stitches on at least two corners can also be provided to contain the fillers. Duvet inserts of the present disclosure are durable and chamfered corners provide a neat and tailored look thereby enhancing bed presentation and also avert accidents such as tripping over the overhanging portion.

8 Claims, 2 Drawing Sheets

(56) References Cited

U.S. PATENT DOCUMENTS

| | | | | | |
|---|---|---|---|---|---|
| 6,769,144 | B1 * | | 8/2004 | Bruske | A47G 9/0223 5/482 |
| D564,276 | S | | 3/2008 | Traficanti | |
| D651,032 | S | * | 12/2011 | Adkins | D6/596 |
| D677,961 | S | | 3/2013 | McKee | |
| D700,458 | S | | 3/2014 | Ngan | |
| D728,971 | S | * | 5/2015 | Harris | D6/603 |
| D769,031 | S | * | 10/2016 | Beamen | D6/608 |
| D787,863 | S | * | 5/2017 | Feeken | D6/611 |
| D821,782 | S | | 7/2018 | Turlick | |
| D838,515 | S | | 1/2019 | Lowchareonkul | |
| D860,684 | S | | 9/2019 | Fowler | |
| 10,413,442 | B2 | | 9/2019 | Tabor et al. | |
| 2007/0061970 | A1 * | | 3/2007 | Breneman | A47G 9/0207 5/497 |
| 2013/0263375 | A1 * | | 10/2013 | Regan | A47G 9/0223 5/500 |
| 2016/0338513 | A1 | | 11/2016 | Mittal et al. | |
| 2019/0282004 | A1 | | 9/2019 | Schwartz | |
| 2019/0307622 | A1 | | 10/2019 | Langer | |

* cited by examiner

DUVET INSERTS AND METHODS OF MANUFACTURE THEREOF

FIELD OF THE DISCLOSURE

The present disclosure relates to the field of bedding, particularly to duvet inserts.

BACKGROUND

Duvets are popular bedding items that provide comfort to a user and at the same time add to the aesthetic appeal of the room by enhancing bed presentation. Duvets include duvet inserts that may be provided with removable duvet covers. Duvet covers that are designed to snugly fit duvet inserts protect duvet inserts when in use and can be washed. Also, duvet covers can be designed to match other bedding items or the room décor to provide a desired look. Duvet inserts on the other hand are more practical and cater to the comfort of the user. Accordingly, duvet inserts are provided with suitable fillers that provide thermal insulation and comfort.

Duvets are large sized when compared to the mattress and generally extend to the foot of the bed with box corners extending from the corners of the bed. The excess portions of the duvet in the form of box corners tend to not only spoil the appearance of the arrangement but also disturb the stability of the duvet insert. An overhang tends to introduce a drag and adds weight to the corners. Also, handling of duvet typically involves tugging at the corners. Frequent handling of the box corners along with the added weight due to the overhang results in uneven migration of fillers contained in the duvet inserts. Migration of fillers mitigates the intended purpose of the duvet and its efficiency reduces with use.

Several endeavors have been made to reduce filler migration. For instance, duvet inserts are sewn-through pinching both sides of the shell or the outermost layers of the duvet inserts together in such a way that seams run perpendicular to each other forming baffle like structure creating pockets of fillers that are contained therein. Some attempts have also been made to configure 'S'-shaped patterns to contain the fillers. However, such stitches are difficult to implement. Skilled labor or machines may be required to first configure such pockets and secondly to ensure that fillers are evenly distributed across the duvet insert.

The example embodiments disclosed addresses the above and other possible needs relating to the field of duvet inserts.

All publications herein, if incorporated, are by reference to the same extent as if each individual publication or patent applications were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Various terms as used herein are shown below. To the extent a term used in the instant application is not defined below, it should be given the broadest definition persons in the pertinent art have given that term as reflected in printed publications and issued patents at the time of filing.

The expression "duvet insert" referred to in the instant application refers to a type of bedding resembling a bag filled with fillers. Duvet inserts can include one or more layers of fabric, insulators, fillers and the like. Duvet inserts can further be provided with duvet covers for protection or aesthetic appeal. All embodiments claimed and described herein with regards to "duvet inserts" are understood to include duvet inserts with duvet covers, if provided separately or as an integral part of the duvet insert. The expression "duvet inserts" may also be interpreted to include "comforters" as referred in some parts of the world.

The expressions "sew" and "stitch" may be used interchangeably to imply fastening or joining by stitching or other forms of bonding, as known in the art and may be a manual process or may involve use of machines.

In some embodiments, the numbers expressing quantities of ingredients, properties such as concentration, reaction conditions, and so forth, used to describe and claim certain example embodiments are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some example embodiments are approximations, the numerical values set forth in the specific examples are reported as precisely as practicable. The numerical values presented in some example embodiments may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values, if used herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the example features and does not pose a limitation on the scope of the claimed subject matter.

Groupings of alternative elements or embodiments, if any, disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY

Aspects of present disclosure relate to duvet inserts and methods of manufacture thereof.

In accordance with an aspect of the present disclosure, a duvet insert can include at least two corners configured to minimize overhang of the corners. In an embodiment, the at least two corners are either chamfered or beveled to ensure that the corners extend downwardly and in close proximity to the mattress on which the duvet insert is placed. In an embodiment, at least two corners of the duvet insert can be provided with at least one of quilted or line stitches for containing fillers and minimizing filler migration.

In an embodiment, the duvet insert can further include a main body that forms the core of the duvet insert. The main body is designed to majorly contain fillers of suitable material, type and volume to provide desired comfort to a user. The main body can be surrounded by a frame that extends along the periphery of the duvet insert. In an embodiment, at least the frame can be configured with intersecting sectional barriers for containing fillers at least within the main body and prevent uneven migration of the fillers, thereby improving stability of the duvet insert.

In an embodiment, the sectional barriers can be defined by stitching a pre-determined pattern such as zigzag, waves, triangle or triangle waves or a combination thereof.

In an embodiment, at least two corners of the duvet insert are provided with quilted or line stitches for containing the fillers and minimizing filler migration during handling In accordance with another aspect of the present disclosure, a method of making a duvet insert can include the operation of configuring at least two corners to prevent the corners from hanging out. In an embodiment, the operation of configuring includes chamfering or beveling of the at least two corners.

In accordance with an embodiment, the operation of chamfering or beveling can include one or more combinations of cutting, folding and stitching to obtain finished contours at the corners.

In accordance with an embodiment, the method of making a duvet insert can further comprise the operation of configuring intersecting sectional barriers at least on a frame defined around a main body and extending along the periphery of the duvet insert such that the sectional barriers contain fillers at least within the main body and minimize migration of fillers.

In accordance with an embodiment, the operation of configuring intersecting sectional barriers can include stitching a pre-determined pattern such as zigzag, waves, triangle or triangle wave stitches or a combination thereof.

In accordance with an embodiment, the method of making a duvet insert can further comprise providing quilted or line stitches on at least two corners of the duvet insert to contain fillers and minimize filler migration.

Some features of the example embodiments disclosed include providing duvet inserts that enable aesthetic bed presentation.

Another feature of the present disclosure is to provide duvet inserts that mitigate migration of fillers.

Still another feature of the present disclosure is to provide duvet inserts that make optimum use of fillers, stitching material and fabric used.

Yet another feature of the present disclosure is to provide cost effective duvet inserts.

Yet another feature of the present disclosure is to provide duvet inserts that are easy to manufacture.

Another feature of the present disclosure is to provide durable duvet inserts.

An additional feature of the present disclosure is to provide duvet inserts that minimize overhang of the corners to avert accidents such as tripping over the overhanging portion.

Various objects, features, aspects and advantages of the inventive subject matter will become more apparent from the following detailed description of preferred embodiments, along with the accompanying drawing figures in which like numerals represent like components

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate example features and does not pose a limitation on the scope of the claimed subject matter.

Embodiments of the present disclosure relate to duvet inserts and methods of manufacture thereof. Duvet inserts are provided with fillers of suitable material, type, and volume to provide desired comfort to a user. Duvet inserts known in the art have box corners that tend to hang out from the corners of the bed and thereby create a drag on the fillers due to the weight of the overhang. Again frequent handling of the duvet insert by the corners further causes migration of fillers resulting in uneven distribution of fillers contained therein and thus defeating the intended purpose of the duvet insert.

Figure 1:
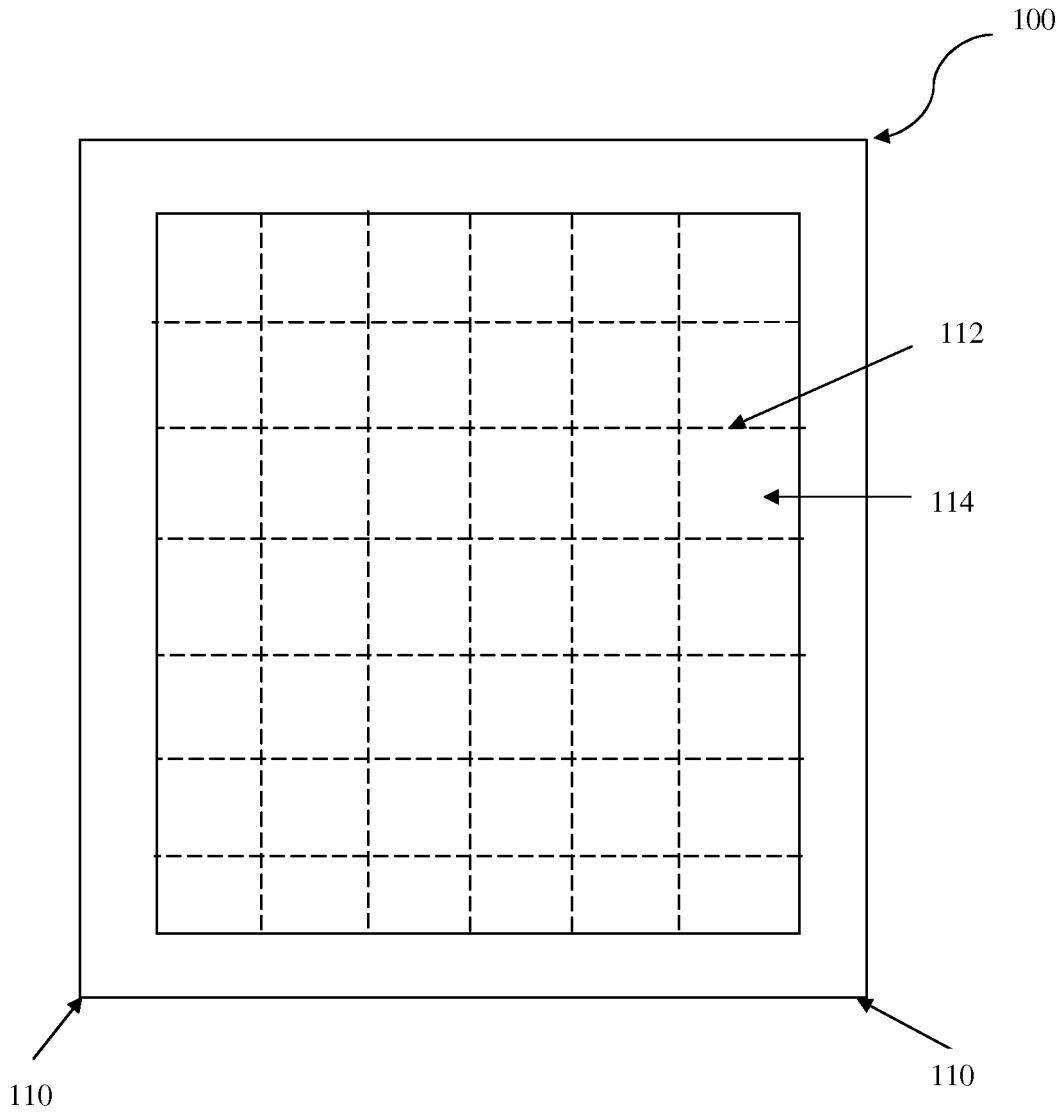
FIGURE 1 (PRIOR ART)
FIG. 1 illustrates a schematic representation of an exemplary duvet insert known in the art.

FIG. 1 illustrates a schematic representation of an exemplary duvet insert 100 known in the art. Box corners 110 hang out or protrude from the corners of the bed when duvet insert 100 is placed on a mattress. Duvet insert 100 is provided with pockets of fillers created by perpendicular seams 112 running across entire main body 114 of duvet insert 100. Box corners 110 mar the bed presentation and also tend to drag the fillers outwards by the weight of the overhang at the corners. Besides the poor presentation, overhanging corners may cause accidents like tripping over the overhanging portions.

Figure 2:
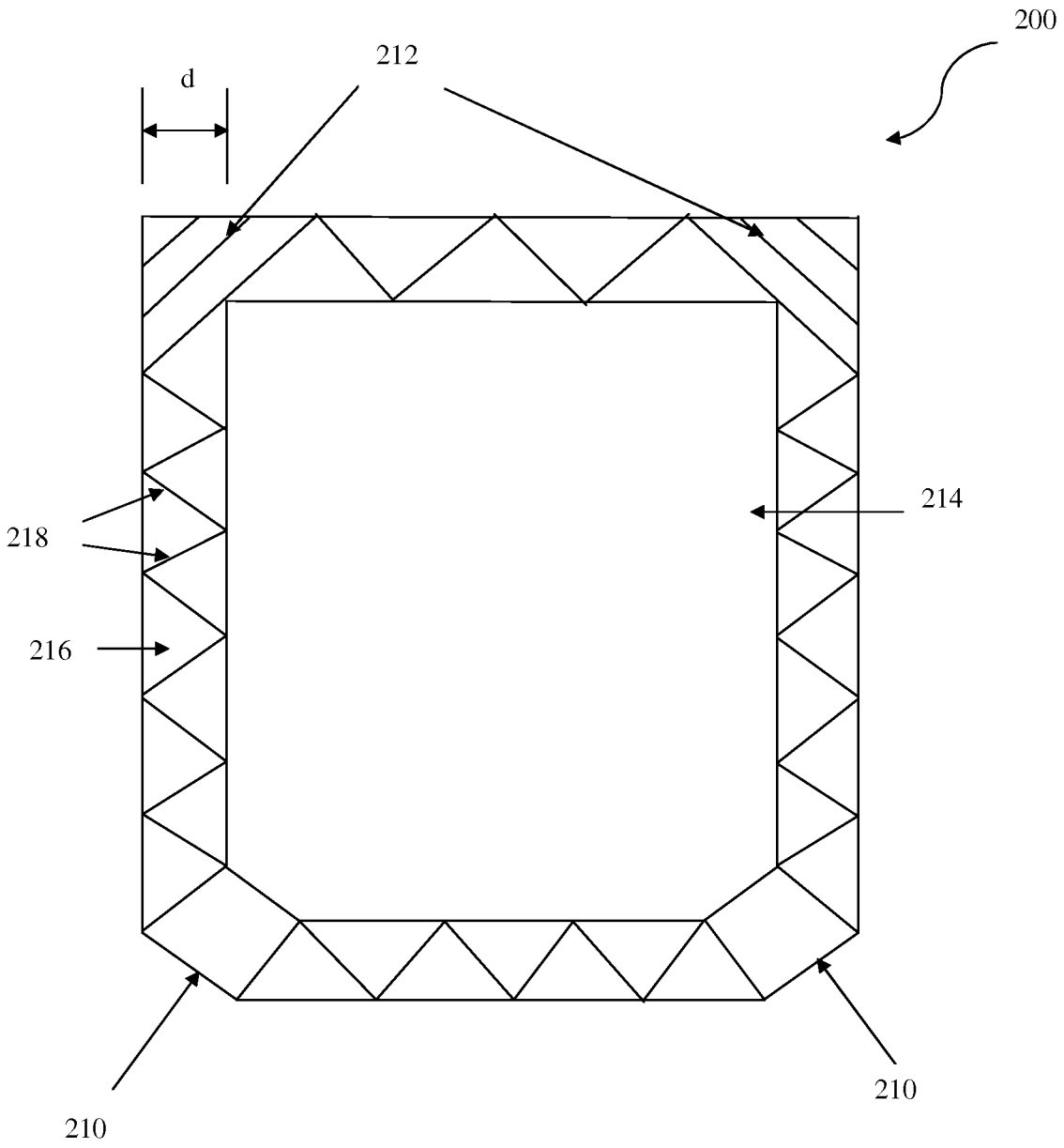
FIG. 2 illustrates a schematic representation of an exemplary duvet insert in accordance with one or more embodiments of the present disclosure.

FIG. 2 illustrates a schematic representation of an exemplary duvet insert 200 in accordance with an embodiment of the present disclosure. In an embodiment, duvet insert 200 is provided with at least two corners 210 that are configured to minimize overhang. In an embodiment, corners 210 can be chamfered or beveled to plane off the box corners seen in traditional duvet inserts such as duvet insert 100 illustrated in FIG. 1 and provide a neat and tailored look that enhances bed presentation. Chamfered or beveled corners 210 extend downwardly in close proximity to the edges of the mattress on which the duvet insert is placed thus minimizing overhang of the corners and enhancing the drape ability of the duvet. Besides improving bed presentation, minimized overhang also minimizes migration of fillers towards the corners which disturbs the stable and intended even distribution of fillers.

In accordance with an embodiment, duvet insert 200 can include main body 214 that essentially includes the core part of the insert and contains bulk of fillers required. Fillers are selected based on requirement and mainly address user comfort. The fillers can be made of natural resources or can be synthetic or man-made. Frame 216 can be defined around main body 214 and extending along the periphery of duvet insert 200 such that frame 216 is configured with intersecting sectional barriers 218 for containing fillers at least within main body 214 and capable of preventing migration and thereby uneven distribution of fillers.

In accordance with an embodiment, frame 216 can be at least three inches wide along the periphery of duvet insert 200, such width is generally referenced as 'd' for illustrative purpose.

In accordance with an embodiment, quantity, type and material of fillers in main body 214 can differ from that in frame 216. A cost effective embodiment can include frame 216 with no fillers or fillers of reduced quantity or of a type that does not necessarily cater to user comfort. It will be appreciated that either main body 214 or frame 216 or both may be provided with one or more layers of fabric or fillers or both as per requirement.

In accordance with an embodiment, sectional barriers 218 can be defined on at least one of frame 216 and main body 214. In accordance with an embodiment, sectional barriers 218 can be defined by stitching a pre-determined pattern. Such sectional barriers are capable of containing fillers and preventing migration of fillers that can lead to poor performance of the duvet insert besides marring the aesthetic look of the bed presentation. The patterns can be at least one of zigzag, waves, triangle, triangle wave, parallel, S shaped stitches or a combination thereof. Particularly, zigzag patterns are easy to implement and saves on stitching material and labor to achieve the desired effect when compared to traditionally known 'S' shaped and other stitch patterns.

In accordance with an embodiment, at least two corners of duvet insert 200 are provided with quilted stitches or line stitches for containing fillers and minimizing filler migration. The illustrated embodiment shows three line stitches 212 provided at each of two corners of duvet insert 200.

In accordance with an aspect of the present disclosure, a method of making a duvet insert can include an operation of configuring at least two corners so that the corners do not protrude and hang out. In an embodiment, the operation of configuring can include chamfering or beveling of the at least two corners. Preventing overhang at the corners enhances the aesthetic appeal of bed presentation since the chamfered or beveled corners no longer have box corners and tend to extend downwardly and not protrude or remain suspended as seen in the art. Again, there is a reduction in drag at the corners that is caused by the weight of the overhang. This reduced drag further mitigates migration of fillers towards the corner.

In accordance with an embodiment, chamfering or beveling can include one or more combinations of cutting, folding and stitching to obtain finished contours at the corners.

In accordance with an embodiment, the method of making a duvet insert can further include the operation of providing at least one of quilted or line stitches on at least two corners of the duvet insert for containing fillers and minimizing filler migration.

In an embodiment, a method of making a duvet insert can include an operation of configuring intersecting sectional barriers at least on a frame defined around a main body and extending along the periphery of the duvet insert. The sectional barriers are configured to contain fillers at least within the main body and prevent uneven migration of fillers. In an embodiment, the method can further include an operation of configuring at least two corners to minimize overhang of the at least two corners by either chamfering or beveling. The method can also include an operation of configuring intersecting sectional barriers by stitching a pre-determined pattern such as zigzag, waves, triangle, triangle wave stitches or a combination thereof. In an embodiment, at least one of quilted or line stitches can be provided on at least two corners of the duvet insert to contain fillers and minimize filler migration.

The present disclosure provides duvet inserts that enable aesthetic bed presentation.

The present disclosure provides duvet inserts that mitigate migration of fillers.

The present disclosure provides duvet inserts that make optimum use of fillers, stitching material and fabric used.

The present disclosure provides cost effective duvet inserts.

The present disclosure provides duvet inserts that are easy to manufacture.

The present disclosure provides durable duvet inserts.

The present disclosure provides duvet inserts that minimize overhang of the corners to avert accidents such as tripping over the overhanging portion.

In addition to the embodiments and examples shown, numerous variants are possible, which may be obvious to a person skilled in the art relating to the various aspects of the disclosure.

The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative operations may be employed.

The use of the expression "at least" or "at least one" suggests the use of one or more elements, as the use may be in one of the embodiments to achieve one or more of the desired objects or results.

It may be appreciated that various other modifications and changes may be made to the embodiment described without departing from the spirit and scope of the disclosure.

The invention claimed is:

1. A duvet insert comprising:

a main body portion comprising fillers of a first material; and a frame having a predetermined width that surrounds the main body portion and extends along the periphery of the duvet insert, wherein the frame is configured with intersecting sectional barriers for containing fillers at least within the main body portion, wherein a first corner and second corner of the duvet insert are either chamfered or beveled to minimize overhang of the first corner and second corner over a bed or mattress; and wherein a third corner and fourth corner of the duvet insert are provided with a plurality of parallel quilted stitches or line stitches for containing fillers and minimizing filler migration, wherein the intersecting barriers form a portion of the plurality of parallel quilted stitches or line stitches at the third corner and the fourth corner of the duvet insert.

2. The duvet insert of claim 1, wherein the sectional barriers are defined by stitching a predetermined pattern.

3. The duvet insert of claim 2, wherein the pre-determined pattern is at least one selected from the group consisting of zigzag, waves, triangle, and triangle wave stitches.

4. The duvet insert of claim 1, wherein the frame is at least three inches wide along the periphery of the duvet insert.

5. A method of making a duvet insert comprising:

providing intersecting sectional barriers on a frame surrounding a main body portion comprising fillers of a first material and extending along the periphery of the duvet insert, the frame having a predetermined width, the sectional barriers adapted to contain fillers at least within the main body and minimize migration of fillers therein;

providing a first corner and second corner of the duvet insert with chamfered or beveled edges to minimize overhang of the first corner and second corner over a bed or mattress; and providing a third corner and fourth corner of the duvet insert with a plurality of parallel quilted or line stitches for containing fillers and minimizing filler migration, wherein the intersecting barriers form a portion of the plurality of parallel quilted stitches or line stitches at the third corner and the fourth corner of the duvet insert.

6. The method of claim 5, wherein the configuring intersecting sectional barriers comprises stitching a predetermined pattern.

7. The method of claim 6, wherein the pre-determined pattern is at least one selected from the group consisting of zigzag, waves, triangle, and triangle wave stitches.

8. The method of claim 5, wherein the frame is at least three inches wide along the periphery of the duvet insert.

* * * * *